US007049040B2

(12) United States Patent
Osan et al.

(10) Patent No.: US 7,049,040 B2
(45) **Date of Patent: *May 23, 2006**

(54) ELECTROSTATICALLY CHARGED IMAGE DEVELOPING TONER CONTAINING A POLYOLEFIN RESIN HAVING A CYCLIC STRUCTURE

(75) Inventors: Frank Osan, Niedernhausen (DE); Thomas Wehrmeister, Rüsselsheim (DE); Horst-Tore Land, Hofheim (DE); Toshimi Nishioka, Suita (JP); Junichi Fukuzawa, Yokohama (JP); Toru Nakamura, Abiko (JP); Takuya Hoga, Urawa (JP); Masayuki Arai, Gyoda (JP); Satoshi Arai, Tokyo (JP)

(73) Assignee: Ticona GmbH (DE)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

This patent is subject to a terminal disclaimer.

(21) Appl. No.: 09/331,729

(22) PCT Filed: Dec. 25, 1997

(86) PCT No.: PCT/JP97/04848

§ 371 (c)(1),
(2), (4) Date: Aug. 26, 1999

(87) PCT Pub. No.: WO98/29783

PCT Pub. Date: Jul. 9, 1998

(65) Prior Publication Data

US 2003/0152858 A1 Aug. 14, 2003

(30) Foreign Application Priority Data

Dec. 26, 1996 (JP) ..... 8-348546

(51) Int. Cl.
*G03G 9/087* (2006.01)

(52) U.S. Cl. ..... 430/108.4; 430/108.8; 430/109.3; 430/109.31

(58) Field of Classification Search ..... 430/109, 430/110, 111, 137, 114, 115, 109.3, 108.8, 430/108.4, 109.31, 109.2, 109.4, 108.3
See application file for complete search history.

(56) References Cited

U.S. PATENT DOCUMENTS

| | | | | |
|---|---|---|---|---|
| 3,585,140 A | | 6/1971 | Machida | |
| 4,659,640 A | * | 4/1987 | Santilli | 430/114 |
| 4,923,778 A | * | 5/1990 | Blair et al. | 430/137 |
| 5,019,477 A | * | 5/1991 | Felder | 430/115 |
| 5,324,616 A | | 6/1994 | Sacripante et al. | 430/137.12 |
| 5,487,965 A | * | 1/1996 | Odell | 430/137.22 |
| 5,707,772 A | * | 1/1998 | Akimoto et al. | 430/110 |
| 5,843,613 A | * | 12/1998 | Fujiwara et al. | 430/114 |
| 6,210,852 B1 | * | 4/2001 | Nakamura | 430/108.2 |
| 6,465,145 B1 | * | 10/2002 | Yamauchi | 430/108.23 |
| 6,790,577 B1 | * | 9/2004 | Nakamura | 430/109.3 |
| 6,846,602 B1 | * | 1/2005 | Suwa et al. | 430/108.4 |

FOREIGN PATENT DOCUMENTS

| | | |
|---|---|---|
| JP | 46-6157 | 2/1971 |
| JP | 6-19220 | 1/1994 |
| JP | 6-27714 | 2/1994 |
| JP | 6-41402 | 2/1994 |
| JP | 6-214431 | 8/1994 |
| JP | 2000-284528 | * 10/2000 |
| WO | WO97/05529 | * 2/1997 |

OTHER PUBLICATIONS

Webster's New Word Dictionary, Third College Edition, Simon & Schuster, Inc, NY (1988), p. 21 ACS File Registry No. RN 64365-06-6, Copyright 2000.*
CAPLUS Abstract AN 1994:459376 (1994) of Japanese Patent 06032917.*
Grant, R. et al, ed. *Grant & Hackh's Chemical Dictionary*, McGraw-Hill Book Company (NY), 1987, p 205.*
English-Language of WO 97/05529 (pub Feb. 1997).*
American Chemical Society File Registry No. 361391-57-3 Copyright 2003.*
Diamond, A.S. ed, *Handbook of Imaging Materials*, Marcel Dekker, Inc., NY (1991), p. 170.*
Diamond, Arthur S., ed., *Handbook of Imaging Materials*, Marcel Dekker, Inc., NY (1991), pp. 227 and 234.*
Diamond, A.S., ed., *Handbook of Imaging Materials, Marcel Dekker*, Inc., NY (1991), pp. 168-169.*

* cited by examiner

*Primary Examiner*—Janis L. Dote
(74) *Attorney, Agent, or Firm*—Connolly Bove Lodge & Hutz

(57) ABSTRACT

A toner for development of an electrostatically charged image, said toner comprising a binder resin, a colorant, a function imparting agent, and a charge control agent, wherein said binder resin at least contains a polyolefin resin having a cyclic structure, said polyolefin resin is composed of a resin or resin fraction having a number average molecular weight (Mn), as measured by GPC, of less than 7,500 and a resin or resin fraction having said number average molecular weight of 7,500 or more, and in said polyolefin resin having a cyclic structure, a resin or resin fraction having an intrinsic viscosity (i.v.) of 0.25 dl/g or more, and a number average molecular weight (Mn) of 7,500 or more and a weight average molecular weight (Mw) of 15,000 or more, as measured by the GPC method, is contained in a proportion of less than 50% by weight based on the entire binder resin.

15 Claims, No Drawings

ELECTROSTATICALLY CHARGED IMAGE DEVELOPING TONER CONTAINING A POLYOLEFIN RESIN HAVING A CYCLIC STRUCTURE

FIELD OF THE INVENTION

The present invention relates to a toner for development of an electrostatically charged image. More specifically, this invention relates to a dry one-component magnetic toner, a dry one-component nonmagnetic toner, a dry two-component toner, a dry polymerized toner, a liquid dried toner, or a liquid toner which, when fixed, is excellent in anti-spent toner effect, and can form a well fixed, highly transparent, sharp image.

The invention also relates to the above-mentioned toner for use in copiers, printers, facsimile machines, color copiers, color laser copiers, color laser printers, and electrophotographic high speed printers.

BACKGROUND OF THE INVENTION

Electrostatically charged image developing copiers and printers are gaining popularity because of widespread office automation. With this background, demand is growing for high grade or sharp copied images which are highly light transmissive and well fixed.

Under these circumstances, we stated to the following effect in Japanese Patent Application No. 354063/95 (filed Dec. 29, 1995), which was not laid open to the public when the present application was filed: "The relevant problem can be solved or diminished by using a polyolefin resin having a cyclic structure as a binder resin for a toner for heat roller fixing type electrostatically charged image developing copiers and printers, and also by incorporating less than 50% by weight of the polyolefin resin with a high viscosity into the entire binder resin. As a result, a sharp, high quality copied image which is excellent in fixing, light transmission and anti-spent toner effect can be obtained. Particularly when this resin is used in a color toner, its characteristics are exhibited."

This previous invention, however, was defective in that it was difficult to get a sufficiently broad offset-free temperature range suitable for practical use, and scarcely achieved an enough fixing property at an even higher copying speed to meet users' requirement.

In fixing a toner image onto plain paper or an OHP film, various fixing methods are available, such as hot roller fixing, hot belt fixing, pressure fixing, radiant heat fixing, or flash fixing. In recent years, energy saving symbolized by "Energystar restriction" has been demanded increasingly, and demand has become intense for a toner fixable at a low temperature and a low pressure. The thermal properties and mechanical properties of conventional styrene-acrylate resins and polyester resins, or the polyolefin resins having a cyclic structure described in Japanese Patent Application No. 354063/95 cannot satisfy the requirements at lower temperatures or pressures than the current level. Improvement in the thermal properties of these resins on one hand resulted in the deterioration of storage stability of the toner on the other hand.

General formulations for toners in electrostatically charged image developing copiers and printers are shown in Table 1.

TABLE 1

General Formulations of Toners (Unit: % by weight)

| | Binder resin | Colorant | Charge control agent | Function imparting agent | Magnetic powder | Solvent |
|---|---|---|---|---|---|---|
| Dry two-component toner | 50-100 | 0-20 | 0-10 | 0-20 | — | — |
| Dry nonmagnetic one-component toner | 50-100 | 0-20 | 0-10 | 0-20 | — | — |
| Dry magnetic one-component toner | 0-100 | 0-20 | 0-10 | 0-20 | 0-60 | — |
| Dry polymerized toner | 50-100 | 0-20 | 0-10 | 0-20 | — | — |
| Liquid dried toner | 15-50 | 0-10 | 0-5 | 0-10 | — | 50-70 |
| Liquid toner | 15-50 | 0-10 | 0-5 | 0-10 | — | 50-70 |

The object of the present invention is to provide a toner in a dry two-component, dry nonmagnetic one-component, dry magnetic one-component, dry polymerized, liquid dried, or liquid toner developer which exhibits the effects achieved by Japanese Patent Application No. 354063/95, is to propose a sufficiently broad offset-free temperature range suitable for practical use, can attain sufficient fixing property even by high speed copying, and gives a higher grade image, namely, good in fixing, highly optically transparent, sharp image in an electrostatically charged image developing copier or printer.

DISCLOSURE OF THE INVENTION

The foregoing object is attained by using as a binder resin for a toner a binder resin which at least contains a polyolefin resin having a cyclic structure, the polyolefin resin having a cyclic structure comprising a resin or resin fraction having a number average molecular weight (Mn), as measured by GPC, of less than 7,500 and a resin or resin fraction having said number average molecular weight of 7,500 or more; and in which in said polyolefin resin having a cyclic structure, a resin or resin fraction having an intrinsic viscosity (i.v.) of 0.25 dl/g or more, a heat distortion temperature (HDT) by the DIN 53461-B method of 70° C. or higher, and a number average molecular weight (Mn) of 7,500 or more and a weight average molecular weight (Mw) of 15,000 or more, as measured by the GPC method, is contained in a proportion of less than 50% by weight based on the entire binder resin.

DIN53461-B states that the test set-up should correspond and comply with the requirements described in sections 3.2 through 3.6 below.

3.2 Bending Device

The bending device consists of two supports and one bending die made of metal. The edges have a radius of curvature of 3±0.2) mm. The support span is (100±2) mm. It must be possible to apply the force in the center of the support span, perpendicular to the orientation of the test body, by means of the bending die. The vertical connecting pieces between the supports, and the cover that the deflection measuring device rests upon, must be made of a material that has the same coefficient of linear expansion as the bending die.

To produce the force, weights which apply a bending stress of 1.80 $N/mm^2$ (method A), 0.45 $N/mm^2$ (method B), or 5.0 $N/mm^2$ (method C) are used. When calculating the mass of the weights, it is necessary to account for the weight of the bending die and, if necessary, the measurement force of the measuring device used to measure deflection. A set of variety of weights is recommended to make it possible to set the necessary bending force (limit deviations ±2.5%).

3.3 Immersion Bath

A suitable heat transfer liquid in which the test body can be immersed must be used for the immersion bath. The bath must have a stirring device. It must be possible to raise the bath temperature at a steady rate of 2 K/min (see Section 5.4).

A heat transfer liquid should be used that is stable at the temperatures employed, and which does not influence the properties of the test body.

3.4 Temperature Measurement Device

The temperatures are measured with 2 temperature measurement devices; tolerances G=0.5 K. The devices must extend to the depth for which the tolerances apply, but no less than 50 mm deep.

3.5 Deflection Measuring Device

The measurement device must be capable of determining the deflection of the test body to 0.01 mm.

3.6 Linear Measurement Device

The linear measurement device must be capable of determining the height and width of the test body to 0.1 mm.

4 Test Bodies 4.1 Shape and Fabrication

The test bodies have a length/ of at least 110 mm, a width b of 3.0 to 4.2 mm, and a height h of 9.8 to 15.0 mm, with the exception of test bodies made of slab products, whose width b may be between 3 and 13 mm. The test bodies should be produced or sampled in such a manner that the force of pressure used in their fabrication has acted on the surface A=/·h.

4.1.1 If not otherwise specified in the relevant standards for the plastic product, or not otherwise agreed between supplier and customer, test bodies of thermosetting molding materials are produced according to DIN 53 451, and test bodies of thermoplastic materials are produced either through injection molding or through compressed molding while taking into account the conditions specified in the relevant standards regarding molding materials.

The test results depend upon the manufacturing conditions of the test body and upon the pretreatment (for example, drying, temperature treatment, conditioning). Hence, precise specifications for these conditions are necessary in arbitrational analysis.

4.2 Quantity

At least 2 test bodies from each sampled product must be tested.

4.3 Pretreatment

The test bodies must be pretreated in accordance with the relevant standards for the molding compound or in accordance with the agreements between supplier and customer.

5 Procedure 5.1 Prior to testing, the width b and the height h are measured to 0.1 mm in the center of the test body.

5.2 The test body in placed on end on the supports. The temperature measurement devices are inserted in such a way that they extend to within 2 mm of, but do not touch, the test body in the vicinity of the pressure die. At the start of each test, the bath temperature should be 20 to 23° C. unless preliminary testing has demonstrated that a different starting temperature does not cause any errors with the product under test.

5.3 The force calculated for methods A, B or C per Section 3.2 is applied to the test body. After the load has been maintained for 5 minutes, the deflection measuring device is set to zero and the heat is turned on. The 5-minute waiting period can be omitted if the test body deflects less than 0.02 mm in this period of time.

5.4 The temperature of the bath is steadily raised by 2 K/min. There must never, at any time during the test, be a difference of more than 1 K between the specified and actual temperatures. The temperature at which the test body has achieved the deflection specified in the following table is the heat deflection temperature.

TABLE 2

| Height h of the Test Body mm | Test Body Deflection mm |
|---|---|
| 9.8 to 9.9 | 0.33 |
| 10.0 to 10.3 | 0.32 |
| 10.4 to 10.6 | 0.31 |
| 10.7 to 10.9 | 0.30 |
| 11.0 to 11.4 | 0.29 |
| 11.5 to 11.9 | 0.28 |
| 12.0 to 12.3 | 0.27 |
| 12.4 to 12.7 | 0.26 |
| 12.8 to 13.2 | 0.25 |
| 13.3 to 13.7 | 0.24 |
| 13.6 to 14.1 | 0.23 |
| 14.2 to 14.6 | 0.22 |
| 14.7 to 15.0 | 0.21 |

5.5 If the heat deflection temperatures of the two test bodies differ from one another by more than 2 K, additional tests must be performed, and the individual values must be given as the results.

In the case of semicrystalline thermoplastics whose glass transition temperature lies between the starting temperature and the heat deflection temperature, it is possible that the deflection temperature function in the range of required deflection defined in Section 5.4 can be sufficiently flat in one of the methods defined in Section 3.2 (e.g., method B) that reproducibility and comparability of the test method become very uncertain. In these cases, the test can only be performed with one of the other methods (e.g. method A or C) described in Section 3.2.

6. Evaluation

The Average Rounded to 1K, of the Individual Values is the Heat Deflection Temperature HDT/A, HDT/B or HDT/C.

Thus, the invention concerns a toner for development of an electrostatically charged image, the toner consisting essentially of a binder resin, a colorant, a function imparting agent (generally, wax as a mold release agent), and a charge control agent, the binder resin at least containing the above-described polyolefin resin having a cyclic structure, the polyolefin resin satisfying the above conditions.

The invention also relates to a liquid dried system containing 30% by weight to 50% by weight of a dried polymerized system containing 0.5% by weight to 5% by weight of a charge control agent, 1% by weight to 10% by weight of wax, 0.1% by weight to 2% by weight of aerosol silica, 1% by weight to 10% by weight of pigment and 85% by weight to 95% by weight of a binder resin, and 50% by weight to 70% by weight of a carrier liquid.

The invention also relates to a liquid toner containing 30% by weight to 50% by weight of a mixture containing 0.5% by weight to 1.5% by weight of carbon black, 0.5% by weight to 1.5% by weight of a charge control agent and 85% by weight to 95% by weight of a binder resin, and 50% by weight to 70% by weight of a carrier liquid.

The polyolefin resin having a cyclic structure used herein is, for example, a copolymer of an α-olefin (broadly, an acyclic olefin), such as ethylene, propylene or butylene, with a cyclic and/or polycyclic compound having at least one double bond, such as cyclohexene or norbornene tetracyclododecene (TCD) and dicyclopentadiene (DCPD), the copolymer being colorless and transparent, and having high light transmission. This polyolefin resin having a cyclic structure is a polymer obtained, for instance, by a polymerization method using a metallocene catalyst or a Ziegler catalyst and catalyst for the metathesis polymerization, therefore double-bond-opening and ring-opening polymerization reactions.

Examples of synthesis of the polyolefin resin having a cyclic structure are disclosed in JP-A-339327/93, JP-A-9223/93, JP-A-271628/94, EP-A-203799, EP-A-407870, EP-A-283164, EP-A-156464 and JP-A-253315/95.

According to these examples, the polyolefin resin is obtained by polymerizing optionally one acyclic olefin monomer with at least one cycloolefin monomer at a temperature of −78 to 150° C., preferably 20 to 80° C., and a pressure of 0.01 to 64 bars in the presence of a catalyst comprising at least one metallocene containing zirconium or hafnium together with a cocatalyst such as aluminoxane. Other useful polymers are described in EP-A-317262, hydrogenated polymers and copolymers of styrene and dicyclopentadiene are useful too.

When dissolved in an inert hydrocarbon such as an aliphatic or aromatic hydrocarbon, the metallocene catalyst is activated. Thus, the metallocene catalyst is dissolved, for example, in toluene for preliminary activation and reaction in the solvent.

The important properties of COC are softening point, melting point, viscosity, dielectric properties, anti off set window and transparency. These properties can be adjusted advantageously by selecting ratio of monomers/comonomers, ratio of comonomers in copolymer, molecular weight, molecular weight distribution, hybrid polymers, blends and additives.

The molar ratio of the acyclic olefin and the cycloolefin charged for the reaction can be varied widely depending on the targeted polyolefin resin having a cyclic structure. This ratio is adjusted, preferably, to 50:1 to 1:50, more preferably 20:1 to 1:20.

When the copolymer components charged for the reaction are a total of two compounds, ethylene as the acyclic polyolefin and norbornene as the cycloolefin, the glass transition point (Tg) of the cyclic polyolefin resin as the reaction product is influenced greatly by their charge proportions. When content of norbornene is increased, the Tg also tends to rise. When the proportion of norbornene charged is approximately 60% by weight, for instance, the Tg is about 60 to 70° C.

The physical properties, such as number average molecular weight are controlled as known from the literatures.

The colorless, transparent, highly light-transmissive polyolefin having a cyclic structure used in the present invention may be a mixture of a low-viscosity resin having a number average molecular weight, as measured by GPC, of less than 7,500, preferably 1,000 to less than 7,500, more preferably 3,000 to less than 7,500, a weight average molecular weight, as measured by GPC, of less than 15,000, preferably 1,000 to less than 15,000, more preferably 4,000 to less than 15,000, an intrinsic viscosity (i.v.) of less than 0.25 dl/g, Tg of preferably lower than 70° C., and a high-viscosity resin having a number average molecular weight, as measured by GPC, of 7,500 or more, preferably 7,500 to 50,000, a weight average molecular weight, as measured by GPC, of 15,000 or more, preferably 50,000 to 500,000, an i.v. of 0.25 dl/g or more. Alternatively, the polyolefin resin may have a molecular weight distribution with a single peak, and contain a resin fraction having a number average molecular weight of less than 7,500 and a resin fraction having a number average molecular weight of 7,500 or more. Alternatively, the polyolefin resin may have two or more peaks, in which its resin fraction having at least one of these peaks has a number average molecular weight of less than 7,500 and its resin fraction having the other peak has a number average molecular weight of 7,500 or more. The resin fractions mentioned here refer to respective resin components before mixing if the polyolefin resin having a cyclic structure is composed of a mixture of different components, such as those with various number average molecular weights; otherwise it refers to resin divisions formed by fractionating the final synthetic product by suitable means such as GPC. If these resin fractions are monodisperse or close to monodisperse, Mn of 7,500 nearly corresponds to Mw of 15,000.

The high-molecular weight/low-molecular weight polyolefin resin having a cyclic structure has the above-mentioned number average molecular weights Mn, weight average molecular weights Mw, intrinsic viscosities i.v. Thus, the Mw/Mn ratio, used as a measure of the degree of dispersion of molecular weight distribution, is as low as from 1 to 2.5, namely, a monodisperse or nearly monodisperse state. Thus, a toner having a quick heat response and a high fixing strength can be produced. This polyolefin resin not only enables fixing at a low temperature and a low pressure, but also contributes to the storage stability, anti-spent toner effect, and electric stability properties such as uniform charge distribution or constant charging efficiency or charge elimination efficiency. If the low viscosity resin, in particular, is monodisperse or nearly monodisperse, the resulting toner shows better heat response characteristics, such as instantaneous melting or setting behavior.

The high-viscosity/low viscosity polyolefin resin having, a cyclic structure, moreover, is colorless, transparent, and highly light-transmissive. For instance, the azo pigment PERMANENT RUBIN® F6B (Hoechst AG) was added to the resin, and the mixture was thoroughly kneaded, and then formed into a sheet by means of a press. This sheet was confirmed to be highly transparent. Thus, the resin is sufficiently usable for a color toner. Measurement by the DSC method has shown this polyolefin resin to require a very low heat of fusion. Hence, this resin can be expected to markedly reduce energy consumption for fixing.

The high-viscosity polyolefin resin having a cyclic structure also has the above-mentioned properties; thus, as contrasted with the low-viscosity polyolefin resin, it imparts structural viscosity to the toner, thereby improving the offset preventing effect and the adhesion to a copying medium such as paper or film.

If the amount of the high-viscosity resin used is 50% by weight or more based on the entire binder resin, the uniform kneading properties extremely decline, impeding the toner performance. That is, a high grade image, i.e., a sharp image with high fixing strength and excellent heat response, cannot be obtained.

The toner for development of an electrostatically charged image according to the present invention has the binder resin at least containing the polyolefin resin having a cyclic structure, in which the polyolefin resins having low viscosity and high viscosity are used as the polyolefin resin. Hence, the offset-free temperature range covers the high temperature side and the low temperature side, the fixing properties by high speed copying are enhanced, and the fixing properties at low temperatures and low pressures are both improved.

To broaden the offset-free temperature range to the low temperature side, the low viscosity polyolefin resin with a number average molecular weight of less than 7,500 contributes. To broaden the offset-free temperature range to the high temperature side, on the other hand, the high viscosity polyolefin resin with a number average molecular weight of 7,500 or more contributes. In order to broaden the offset-free temperature range to the high temperature side more effectively, it is preferred for the high viscosity polyolefin resin with a number average molecular weight of 20,000 or more to be present. The proportions of the cyclic structure polyolefin resins with number average molecular weights of less than 7,500 and 7,500 or more contained in the entire binder resin are each preferably 0.5 part by weight or more, more preferably 5 parts by weight or more, based on 100 parts by weight of the entire binder resin. If the content of each polyolefin resin is less than 0.5 part by weight, it is difficult to obtain a practical broad offset-free temperature range.

In the case of the polyolefin resin having a cyclic structure composed of the low viscosity polyolefin resin with a number average molecular weight of less than 7,500 and the high viscosity polyolefin resin with a number average molecular weight of 25,000 or more, a medium viscosity polyolefin resin having a cyclic structure with a number average molecular weight of 7,500 or more but less than 25,000 is added to enhance the compatibility of these low and high viscosity polyolefin resin components. This addition has been found effective in bringing an offset-free range continuously.

In other words, the binder resin at least containing a polyolefin resin having a cyclic structure, the polyolefin resin comprising resins or resin fractions having three molecular weight ranges expressed by number average molecular weight (Mn), as measured by GPC, of less than 7,500, 7,500 or more but less than 25,000, and 25,000 or more is also an advantageous embodiment of the present invention. The resin fractions constituting the respective molecular weight ranges may be a resin having a molecular weight distribution with one or two peaks that can be divided into fractions with the above three molecular weight ranges expressed as Mn. Alternatively, the resin fractions constituting the respective molecular weight ranges may be a mixture of resins having molecular weight distributions with three or more peaks that have at least one molecular weight peak in each of the above molecular weight ranges.

The proportion of the medium viscosity polyolefin resin or resin fraction for increasing compatibility is preferably 1 part by weight or more, more preferably 5 parts by weight or more, based on 100 parts by weight of the entire binder resin.

In the present invention, a toner using as a binder resin a mixture of the polyolefin resin, composed of resins or resin fractions with Mn of less than 7,500 and Mn of 7,500 or more, and other resin also realizes a high grade image, i.e., a high fixing strength and sharp image. The other resin refers to one of a polyester resin, an epoxy resin, a polyolefin resin, a vinyl acetate resin, a vinyl acetate copolymer resin, a styrene-acrylate resin and other acrylate resin, or a mixture or a hybrid polymers of any of the mentioned polymers. The proportions of the polyolefin resin having a cyclic structure and the other resin used in the binder resin are 1 to 100, preferably 20 to 90, more preferably 50 to 90 parts by weight of the former, and 99 to 0, preferably 80 to 10, more preferably 50 to 10 parts by weight of the latter, based on 100 parts by weight of the binder resin. If the amount of the former resin is less than 1 part by weight, it becomes difficult to obtain a high grade image.

By introducing carboxyl groups into the polyolefin resin having a cyclic structure, its compatibility with the other resin and the dispersibility of the pigment can be improved. Furthermore, the adhesion to paper or film, a copying medium, can be enhanced, leading to increased fixability. Two-stage reaction method of polymerizing the polyolefin resin having a cyclic structure first, and introducing carboxyl groups subsequently is preferred.

At least two methods are available for introducing the carboxyl groups into the resin. One is a method of oxidizing an alkyl group, such as methyl, at the end of the resin by the fusing air oxidation method to convert it into a carboxyl group. With this method, however, the polyolefin resin of a cyclic structure that has been synthesized using a met allocene catalyst has few branches, making it difficult to introduce many carboxyl groups into this resin. The other method is to add a peroxide to the resin, and react maleic anhydride or other ester and ester derivatives, amides and other polar unsaturated compounds with the resulting radical portion. With this method, it is theoretically possible to introduce many carboxyl groups onto the resin, but an increased proportion of introduction results in yellowing of the resin, making its transparency poor. If the use of the product is restricted to a toner, therefore, it is preferred to introduce 1 to 15% by weight, based on the resin, of maleic anhydride. The same improvement can be achieved by introducing hydroxyl groups or amino groups by a known method.

To improve the Fixing-ability of the toner, a cross linked structure may be introduced into the polyolefin resin having a cyclic structure. One of the methods for introducing this crosslinked structure is to add a diene monomer, such as norbornadiene or cyclohexadiene, together with the acyclic olefin and the cycloolefin, followed by reacting the system, thereby obtaining a terpolymeric polyolefin having a cyclic structure.

As a result of this method, the resin has a terminal showing activity even without a crosslinking agent. A known chemical reaction such as oxidation or epoxidation, or the addition of a crosslinking agent to form a crosslinked structure, results in the functioning of the resin.

Another method is to add a metal such as zinc, copper or calcium to the polyolefin resin of a cyclic structure having carboxyl groups introduced therein, and then blend and melt the mixture with a screw or the like to disperse the metal uniformly as fine particles in the resin, thereby forming an ionomer having a crosslinked structure. Concerning a technology itself on such an ionomer, U.S. Pat. No. 4,693,941, for example, discloses a terpolymer of ethylene containing carboxyl groups which may take the form of a divalent metal salt upon partial or complete neutralization in an attempt to obtain toughness. JP-A-500348/94 reports a polyester resin molded product containing an ionomer of an unsaturated carboxylic acid that has about 20 to 80% of the carboxylic acid groups neutralized with zinc, cobalt, nickel, aluminum or copper (II), the product intended for the same purpose.

The toner of the present invention uses a known function imparting agent to enhance the offset preventing effect. To improve this performance further, the addition of wax has been found effective. As a polar wax, at least one wax selected from amide wax, carnauba wax, higher fatty acids and their esters, higher fatty acid metallic soaps, partially saponified higher fatty acid esters, and higher aliphatic alcohols can be used as the function imparting agent. As a nonpolar wax, at least one wax selected from polyolefin wax and paraffin wax can be used as the function imparting agent.

The polar wax may work as an external lubricant for the difference in polarity. The nonpolar wax may work as an external lubricant mainly because of easy surface migration due to its low molecular weight, contributing to improved offset-free properties.

The toner for development of an electrostatically charged image according to the present invention can be obtained by adding a colorant, a charge control agent, a function imparting agent, and if desired, other additives to the aforementioned binder resin, and performing known methods such as extrusion, kneading, grinding and classification. A flowing agent and a lubricant are further added.

The colorant maybe a known one, such as carbon black, diazo yellow, phthalocyanine blue, quinacridone, carmine 6B, monoazo red or perylene.

Examples of the charge control agent are known ones such as Nigrosine dyes, fatty acid modified Nigrosine dyes, metallized Nigrosine dyes, metallized fatty acid modified Nigrosine dyes, chromium complexes of 3,5-di-tert-butylsalicylic acid, quaternary ammonium salts, triphenylmethane dyes, and azochromium complexes.

To the toner of the present invention, there may be further added a flowing agent such as colloidal silica, aluminum oxide or titanium oxide, and a lubricant comprising a fatty acid metal salt such as barium stearate, calcium stearate or barium laurate.

The toner of the present invention can be used as a dry one-component magnetic toner, a dry one-component nonmagnetic toner, a dry two-component toner, a dry polymerized toner, a liquid dried toner, or a liquid toner. This invention is applicable to a copier, a printer, a facsimile machine and an electrophotographic high speed printer. The invention is also applicable as a full-color toner in a color copier, a color laser copier and a color laser printer.

EXAMPLES

The present invention will be described in more detail by reference to Examples and Comparative Examples.

The physical properties of the polyolefin resin having a cyclic structure used in the invention are measured by the following methods:

GPC Conditions for Measurement of Molecular Weight

Molecular weight conversion method:

Standard polyethylene is used.

| | |
|---|---|
| Column used: | JORDI-SAEULE 500x10 LINEAR |
| Mobile phase: | 1,2-dichlorobenzene (135° C.) (flow rate 0.5 ml/min) |
| Detector: | Differential refractometer |

Method for Measurement of Intrinsic Viscosity:

Inherent viscosity at 135° C. when 1.0 g of the resin was uniformly dissolved in 100 ml of decalin <Toner Preparation Method 1>

Dry nonmagnetic one component system and dry two component system:

One % by weight of a charge control agent (COPY CHARGE NX®, Hoechst AG), 4% by weight of amide wax (BNT, Nippon Seika), 0.5% by weight of aerosol silica (HDK-H2000, Wacker Chemie), 5% by weight of magenta pigment (PERMANENT RUBIN® F6B, Hoechst AG) as a colorant, and 89.5% by weight of a binder resin were mixed, and melt kneaded at 130° C. by a twin roll. Then, the mixture was cooled to solidification, and coarsely crushed, followed by finely dividing the particles using a jet mill. The resulting fine particles were classified to select particles with an average particle diameter of about 10 μm, thereby preparing a toner.

<Toner Preparation Method 2>

Dry Magnetic One Component System:

Forty % by weight of a magnetic powder (BL100, Titanium Industry), 1% by weight of a charge control agent (COPY CHARGE NX®, Hoechst AG), 4% by weight of wax (BNT, Nippon Seika), 0.5% by weight of aerosol silica (HDK-H2000, Wacker Chemie), 2.0% by weight of calcium carbonate (Shiraishi Calcium) as an extender pigment and a structural viscosity improver, and 52.5% by weight of a binder resin were mixed, and melt kneaded at 150° C. by a twin roll. Then, the mixture was cooled to coagulation, and coarsely ground, followed by finely dividing the particles using a jet mill. The resulting fine particles were classified to select particles with an average particle diameter of about 10 μm, thereby preparing a toner.

<Toner Preparation Method 3>

Dry Polymerized System:

One % by weight of a charge control agent (COPY CHARGE NX®, Hoechst AG), 4% by weight of wax (BNT, Nippon Seika), 0.5% by weight of aerosol silica (HDK-H2000, Wacker Chemie), and 5% by weight of magenta pigment (PERMANENT RUBIN® F6B, Hoechst AG) as a colorant were mechanically dispersed and mixed in monomer components corresponding to 89.5% by weight of a binder resin at the time of polymerization of the binder resin. The mixture was interfacially polymerized into particles with an average particle diameter of about 10 μm, thereby preparing a toner.

<Toner Preparation Method 4>

Liquid Dried System:

Forty % by weight of the toner obtained with the formulation of the dry polymerized system and 60% by weight of a carrier liquid (ISOPAR H®, Exxon) were mixed, and kneaded by a sand mill to prepare a toner.

<Toner Preparation Method 5>

Forty % by weight of a mixture consisting of 1 part by weight of carbon black (MA-7, Mitsubishi Chemical Corp.) as a colorant, 0.5 part by weight of a charge control agent (REFLEX BLUE® R51, Hoechst AG), and 98.5 parts by weight of a binder resin was mixed with 60% by weight of a carrier liquid (ISOPAR H®, Exxon). The mixture was kneaded with a sand mill to prepare a toner.

TABLE 1

| Ex. or Comp. Ex. No. | Toner preparation method | Formulation of binder resin: Sample No. | Weight % | Sample No. | Weight % |
|---|---|---|---|---|---|
| Ex. 1 | 1 and 3 | 1 | 89.5 | — | — |
| Ex. 2 | 1 and 3 | 1 | 60 | 2 | 29.5 |
| Ex. 3 | 1 and 3 | 1 | 60 | 7 | 29.5 |
| Ex. 4 | 1 and 3 | 3 | 89.5 | — | — |
| Ex. 5 | 1 and 3 | 3 | 60 | 7 | 29.5 |
| Ex. 6 | 1 and 3 | 5 | 89.5 | — | — |
| Ex. 7 | 1 and 3 | 5 | 60 | 7 | 29.5 |
| Ex. 8 | 1 and 3 | 1 | 60 | 2 | 14.5 |
| | | | | 9 | 15 |
| Ex. 9 | 2 | 1 | 52.5 | — | — |
| Ex. 10 | 2 | 1 | 30 | 2 | 22.5 |
| Ex. 11 | 2 | 1 | 30 | 7 | 22.5 |
| Ex. 12 | 2 | 1 | 30 | 8 | 22.5 |
| Ex. 13 | 2 | 3 | 52.5 | — | — |
| Ex. 14 | 2 | 3 | 30 | 7 | 22.5 |
| Ex. 15 | 2 | 3 | 30 | 8 | 22.5 |
| Ex. 16 | 2 | 5 | 52.5 | — | — |
| Ex. 17 | 2 | 5 | 30 | 7 | 22.5 |
| Ex. 18 | 2 | 5 | 30 | 8 | 22.5 |
| Ex. 19 | 2 | 1 | 30 | 2 | 11 |
| | 2 | | | 9 | 11.5 |
| Comp. Ex. 1 | 1 and 3 | 7 | 89.5 | — | — |
| Comp. Ex. 2 | 1 and 3 | 8 | 89.5 | — | — |
| Comp. Ex. 3 | 2 | 7 | 52.5 | — | — |
| Comp. Ex. 4 | 2 | 8 | 52.5 | — | — |

Table 2 shows the fundamental properties of the polyolefin resin having a cyclic structure used in the present invention.

TABLE 2

| Sample No. | Name | Fundamental properties: Mw | Mn | i.v. | HDT | Mw/Mn | Tg |
|---|---|---|---|---|---|---|---|
| 1 | MT 845 | 6250 | 3350 | 0.19 | <70 | 1.9 | 61 |
| 2 | MT 854 | 66100 | 27700 | 1.39 | ≧70 | 2.4 | 66 |
| 3 | T-745'-MO | 6800 | 3400 | <0.25 | <70 | 2.0 | 78 |
| 5 | T-745'-CL | 12000 | 3900 | <0.25 | <70 | 3.5 | 76 |
| 7 | Tafton NE 2155: Polyester resin, Kao Corp. | | | | | | |
| 8 | MC 100: Styrene acrylate resin, NIPPON CARBIDE INDUSTRIES | | | | | | |
| 9 | MT849 | 40100 | 22200 | 0.7 | ≧70 | 1.8 | 65 |
| 10 | T-745 | 7000 | 3800 | 0.19 | <70 | 1.8 | 68 |

Tg: Glass transition point

Sample No. 1 (MT845), No. 2 (MT854) and No. 9 (MT849) are polyolefin resins having a cyclic structure and having a low viscosity, a high viscosity and a medium viscosity, respectively.

TABLE 2-continued

| Sample No. | Name | Fundamental properties: Mw | Mn | i.v. | HDT | Mw/Mn | Tg |
|---|---|---|---|---|---|---|---|

Sample No. 3 (T-745'-MO): Prepared by reacting Sample No. 10 (T-745), a copolymer of ethylene and norbornene, with a peroxide and 7% by weight, based on T-745, of maleic anhydride to introduce carboxyl groups therein.

Sample No. 5 (T-745'-CL): Prepared by neutralizing about 70% of the carboxyl groups of Sample No. 3 (T-745'-MO), which has carboxyl groups introduced therein, with zinc for conversion into an ionomer.

TAFTON NE ® 2155: Tg = 65° C.

MC100: Tg = 69° C., Mw = 53000, Mn = 23000, Mw/Mn = 2.3

The toners prepared by the above toner preparation methods 1, 2 and 3 were each placed in a commercially available electrophotographic copier (PC100, Canon Inc.), and subjected to performance test. Then, the toners prepared by the toner preparation methods 4 and 5 were each placed in a commercially available electrophotographic copier (FT400i, Ricoh Co., Ltd.), and subjected to performance test. The results are shown in Table 3.

TABLE 3

| | Fixability 10 copies/min | Image sharpness: Thin line resolving power | Gray scale | Light transmission 624 nm | Anti-spent toner effect | Offset-free properties |
|---|---|---|---|---|---|---|
| Ex. 1 | ○ | ○ | ○ | ○ | ○ | Δ |
| Ex. 2 | ○ | ○ | ○ | ○ | ○ | ○ |
| Ex. 3 | ○ | Δ | Δ | Δ | Δ | Δ |
| Ex. 4 | ◎ | ○ | ○ | ○ | ○ | Δ |
| Ex. 5 | ◎ | ○ | ○ | ○ | ○ | Δ |
| Ex. 6 | ◎ | ○ | ○ | ○ | ○ | ○ |
| Ex. 7 | ◎ | Δ | Δ | Δ | Δ | ○ |
| Ex. 8 | ◎ | ○ | ○ | ○ | ○ | ◎ |
| Ex. 9 | ○ | ○ | ○ | — | ○ | Δ |

TABLE 3-continued

| | Fixability 10 copies/min | Image sharpness Thin line resolving power | Image sharpness Gray scale | Light transmission 624 nm | Anti-spent toner effect | Offset-free properties |
|---|---|---|---|---|---|---|
| Ex. 10 | ○ | ○ | ○ | — | ○ | ○ |
| Ex. 11 | ○ | ○ | ○ | — | Δ | Δ |
| Ex. 12 | ○ | ○ | ○ | — | Δ | Δ |
| Ex. 13 | ◎ | ○ | ○ | — | ○ | Δ |
| Ex. 14 | ◎ | ○ | ○ | — | ○ | Δ |
| Ex. 15 | ◎ | ○ | ○ | — | ○ | Δ |
| Ex. 16 | ◎ | ○ | ○ | — | ○ | ○ |
| Ex. 17 | ◎ | ○ | ○ | — | Δ | ○ |
| Ex. 18 | ◎ | ○ | ○ | — | Δ | ○ |
| Ex. 19 | ◎ | ○ | ○ | ○ | ○ | ◎ |
| Comp. Ex. 1 | X | Δ | Δ | ○ | X | X |
| Comp. Ex. 2 | X | X | X | X | X | X |
| Comp. Ex. 3 | X | ○ | ○ | — | X | X |
| Comp. Ex. 4 | X | ○ | ○ | — | X | X |

In Examples 1 to 8 and Comparative Examples 1 and 2, two methods for toner preparation are employed. However, the toner formulation and the resin structure are common, so that the results on the evaluation items are the same.

Evaluation Methods and Evaluation Criteria

1) Fixing-Ability

The toners prepared with the respective formulations were each used for copying onto recycled papers at a copying rate of 10 copies/min at a fixing temperature of 110 to 140° C., with the fixing temperature for each copying cycle being raised by 10° C. The resulting copy samples were rubbed 10 times with an eraser by using an abrasion tester of Southerland. The load during the test was 40 g/cm$^2$. The tested samples were measured for the printing density using a Macbeth reflection densitometer. The symbol X was assigned when even one of the measured values at the respective temperatures was less than 65%. The symbol Δ was assigned when the measured values at the respective temperatures were 65% or more but less than 75%. The symbol ○ was assigned when the measured values at the respective temperatures were 75% or more but less than 85%. The symbol ◎ was assigned when the measured values at the respective temperatures were 85% or more.

2) Image Sharpness

The toners prepared with the respective formulations were each used for copying onto recycled papers. The resulting samples were checked against sample images of Data Quest. The thin line resolving power and gray scale of the copy image were used as bases for evaluation. The symbol X was assigned for a thin line resolving power of 200 dots/inch or less, Δ for a thin line resolving power of 201 to 300 dots/inch, and ○ for a thin line resolving power of 301 dots/inch or more. The ratio of the reflection density of the copy image to the reflection density of the sample image, at each step of the gray scale, was evaluated as X when less than 65%, Δ when 65% or more but less than 75%, and ○ when 75% or more.

3) Light Transmission

The magenta-colored toners prepared with the formulations of the Examples and the Comparative Examples were each used to produce sheet-shaped samples 100 μm thick. The light transmission of each sheet sample was measured using an optical filter having a peak at 624 nm. The light transmittance rate at 624 nm was evaluated as X when less than 8%, Δ when 8% or more but less than 11%, and ○ when 11% or more.

4) Anti-Spent Toner Effect

The toner described in each of the Examples and the Comparative Examples and a ferrite carrier of Powdertech were put in predetermined amounts into a developer box. After the mixture was agitated and triboelectrically treated for 1 week, 5 g of the toner-deposited carrier was weighed. This toner-deposited carrier was put in soapy water to remove the toner electrostatically adhering to the surface. Only the carrier magnetic powder was withdrawn using a magnet. The magnetic powder was immersed in acetone to dissolve and remove the spent toner fused to the surface. A change in the weight after immersion compared with the weight before immersion was evaluated as ○ when less than 0.2%, Δ when 0.2 or more but less than 0.5%, and X when 0.5% or more.

5) Offset-Free Properties

The toners prepared with the respective formulations were each used for copying onto recycled papers at a copying rate of 10 copies/min at a fixing temperature of 90 to 180° C., with the fixing temperature for each copying cycle being raised by 10° C. The printing density of the non-image areas of the resulting samples was measured using a Macbeth reflection densitometer. The printing density of 0.2 or less (printing density of paper=0. 15) represented an offset-free state. The difference between the upper limit and lower limit temperatures in the offset-free state was evaluated as X when 0° C., Δ when 1 to 20° C., ○ when 21 to 40° C., and ◎ when higher than 40° C.

The invention claimed is:

1. A toner for developing an electrostatically charged image, the toner comprising (a) a binder resin comprised of at least one polyolefin resin having a cyclic structure, wherein the polyolefin resin having a cyclic structure comprises:

(i) a first resin or a first resin fraction with a number average molecular weight (Mn), as measured by GPC, of less than 7,500, and (ii) a second resin or a second resin fraction with a number average molecular weight (Mn) of 7,500 or more, Mw of 15,000 or more, a heat distortion temperature as measured by the DIN 53461-B method of 70° C. or higher and an intrinsic viscosity of 0.25 dl/g or more;

(b) a colorant;

(c) a function imparting agent; and (d) a charge control agent and wherein said first resin or said first resin fraction and said second resin or said second resin fraction must be present and said second resin or second resin fraction is contained in a proportion of less than 50% by weight based on the entire binder resin.

2. The toner for developing an electrostatically charged image as claimed in claim 1, wherein the binder resin consists of 1 to 100 parts by weight of the polyolefin resin having a cyclic structure, and 99 to 0 parts by weight of a resin selected from the group consisting of (a) a polyester resin, (b) an epoxy resin, (c) a polyolefin resin, (d) a vinyl acetate resin, (e) a vinyl acetate copolymer resin, (f) an acrylate resin, (g) a styrene-acrylate resin and mixtures of (a)–(g).

3. The toner for developing an electrostatically charged image as claimed in claim 1, wherein the polyolefin resin having a cyclic structure has at least one polar functional group selected from the group consisting of a carboxyl group, a hydroxyl group and an amino group.

4. The toner for developing an electrostatically charged image as claimed in claim 1, wherein the polyolefin resin having a cyclic structure has at least one carboxyl group introduced therein having uniformly dispersed therein fine particles of a metal thereby forming an ionomer having crosslinked structure.

5. The toner for developing an electrostatically charged image as claimed in claim 1, wherein the polyolefin resin having a cyclic structure has a crosslinked structure.

6. The toner for developing an electrostatically charged image as claimed in claim 5, wherein the polyolefin resin having a cyclic structure has a structure crosslinked by a diene wherein the crosslinked structure is obtained by the reaction of (a) a diene monomer with (b) an acyclic olefin and (c) a cycloolefin.

7. The toner for developing an electrostatically charged image as claimed in claim 6, wherein the diene monomer is selected from the group consisting of norbornadiene and cyclohexadiene.

8. The toner for developing an electrostatically charged image as claimed in claim 1, wherein the imparting agent is at least one polar wax.

9. The toner for developing an electrostatically charged image as claimed in claim 8, wherein said at least one polar wax is selected from the group consisting of amide wax, carnauba wax, higher fatty acids and esters thereof, higher fatty acid metallic soaps, partially saponified higher fatty acid esters and higher aliphatic alcohols.

10. The toner for developing an electrostatically charged image as claimed in claim 1, wherein at least one nonpolar wax is used as the function imparting agent.

11. The toner for developing an electrostatically charged image as claimed in claim 10, wherein said at least one nonpolar wax is selected from the group consisting of polyolefin wax and paraffin wax.

12. The toner as claimed in claim 1, wherein said second resin or said second resin fraction is present in amount from 18.8% to less than 50% by weight based on the entire binder resin.

13. A toner for developing an electrostatically charged image, the toner comprising:

(a) a binder resin comprised of at least one polyolefin resin having a cyclic structure, wherein the polyolefin resin having a cyclic structure comprises:

(i) a first resin or a first resin fraction with a number average molecular weight (Mn), as measured by GPC, of less than 7,500, and (ii) a second resin or a second resin fraction with a number average molecular weight (Mn) of 7,500 or more, Mw of 15,000 or more, a heat distortion temperature as measured by the DIN 53461-B method of 70° C. or higher and an intrinsic viscosity of 0.25 dl/g or more;

(b) a colorant;

(c) a function imparting agent; and (d) a charge control agent, wherein said second resin or said second resin fraction is contained in a proportion of less than 50% by weight based on the entire binder resin and wherein said second resin or said second resin fraction is present and said polyolefin resin having a cyclic structure is a copolymer of an acyclic olefin and a cycloolefin compound having at least one double bond.

14. The toner for developing an electrostatically charged image as claimed in claim 13, wherein the acyclic olefin is present and is an alpha-olefin selected from the group consisting of ethylene, propylene and butylene.

15. A toner for developing an electrostatically charged image, the toner comprising (a) a binder resin comprised of at least one polyolefin resin having a cyclic structure comprising at least three different resins or resin fractions having molecular weight ranges expressed by number average molecular weight (Mn), as measured by GPC, (i) of less than 7500 which is a first resin or first resin fraction, (ii) 7500 or more but less than 25,000, Mw of 15,000 or more, and an intrinsic viscosity of 0.25 dl/g or more which is a second resin or second resin fraction, and (iii) 25,000 or more, Mw of 15,000 or more, and an intrinsic viscosity of 0.25 dl/g or more which is also part of a third resin or a third resin fraction, and wherein said first resin or said first resin fraction and said second resin or said second resin fraction and the third resin or third resin fraction must be present and said second resin and third resin or second resin fraction and third resin fraction are contained in a proportion of less than 50% by weight based on the entire binder resin, (b) a colorant;

(c) a function imparting agent; and (d) a charge control agent.

* * * * *